US010008343B2

(12) United States Patent
Julian

(10) Patent No.: US 10,008,343 B2
(45) Date of Patent: Jun. 26, 2018

(54) SAFETY INTERLOCK DOOR SWITCH OVERRIDE TOOL

(71) Applicant: Glenn Michael Julian, Lincoln, CA (US)

(72) Inventor: Glenn Michael Julian, Lincoln, CA (US)

( * ) Notice: Subject to any disclaimer, the term of this patent is extended or adjusted under 35 U.S.C. 154(b) by 0 days. days.

(21) Appl. No.: 15/419,701

(22) Filed: Jan. 30, 2017

(65) Prior Publication Data

US 2017/0323742 A1 Nov. 9, 2017

Related U.S. Application Data

(60) Provisional application No. 62/330,845, filed on May 3, 2016.

(51) Int. Cl.
*H01H 27/00* (2006.01)
*H01H 9/20* (2006.01)
*H01H 11/00* (2006.01)

(52) U.S. Cl.
CPC ..... *H01H 9/20* (2013.01); *H01H 11/00* (2013.01); *H01H 27/00* (2013.01)

(58) Field of Classification Search
CPC ..... H01H 11/00; H01H 9/20; H01H 27/00; F16P 3/08; F16P 3/10
USPC ..... 200/43.01, 43.04, 61.58 R, 61.85; 16/110.1, 422, 436, 444, 446
See application file for complete search history.

(56) References Cited

U.S. PATENT DOCUMENTS

| | | | | |
|---|---|---|---|---|
| 5,682,653 | A | 11/1997 | Berglof | |
| 6,274,832 | B1 | 8/2001 | Tachibana | |
| 6,437,260 | B1 * | 8/2002 | Win-Long | H01H 3/16 200/43.04 |
| 7,335,840 | B2 * | 2/2008 | Young | H01H 3/022 200/43.01 |
| 7,394,036 | B2 * | 7/2008 | Aartsen | H01H 27/002 200/334 |
| D621,683 | S | 8/2010 | Mullenix | |
| 8,749,973 | B2 * | 6/2014 | Nan | G06F 1/187 16/110.1 |
| 2007/0278208 | A1 | 12/2007 | Mullenix | |
| 2009/0223331 | A1 | 9/2009 | Jordan | |
| 2012/0024118 | A1 | 2/2012 | Mullenix | |

OTHER PUBLICATIONS

Advertisements for ESP Company, product named, "Old_Switcheroo", dated 2015.

* cited by examiner

*Primary Examiner* — Vanessa Girardi
(74) *Attorney, Agent, or Firm* — Inventive Patent Law P.C.; Jim H. Salter

(57) ABSTRACT

An apparatus and method for a safety interlock door switch tool are disclosed. An example embodiment includes: support posts having a top end and a bottom end; base elements coupled to the bottom end of the support posts, an attachment mechanism being coupled to the base elements; a grip element coupled to the top end of the support posts; and a plurality of switch depression surfaces formed between the support posts, each of the plurality of switch depression surfaces being configured to engage and activate a particular type of safety interlock door switch.

14 Claims, 7 Drawing Sheets

SAFETY INTERLOCK DOOR SWITCH OVERRIDE TOOL

PRIORITY PATENT APPLICATION

This is a non-provisional patent application claiming priority to U.S. provisional patent application, Ser. No. 62/330,845; filed May 3, 2016. This non-provisional patent application claims priority to the referenced provisional patent application. The entire disclosure of the referenced patent application is considered part of the disclosure of the present application and is hereby incorporated by reference herein in its entirety.

TECHNICAL FIELD

The disclosed subject matter relates to the field of electrical interlock switches used in heating, cooling and ventilating equipment for structures, electrical appliances, and other applications needing electrical safety interlocks, and particularly although not exclusively, to an apparatus and method for a safety interlock door switch tool.

COPYRIGHT

A portion of the disclosure of this patent document contains material that is subject to copyright protection. The copyright owner has no objection to the facsimile reproduction of the patent document or the patent disclosure, as it appears in the U.S. Patent and Trademark Office patent files or records, but otherwise reserves all copyright rights whatsoever. The following notice applies to the disclosure provided herein and to the drawings that form a part of this document: Copyright 2015-2017, Glenn Michael Julian; All Rights Reserved.

BACKGROUND

Electrical appliances such as dryers, heating, ventilating, and air conditioning (HVAC) units, and the like are well known in the art and understood to be commonplace in industrial and residential applications. The common HVAC unit or appliance configuration typically includes an access door or panel that mechanically interacts with a safety interlock switch. The safety interlock switch is depressed or activated when the access door or panel is in the closed position. In this case, the HVAC unit or electrical appliance is "hot" and electrical power is enabled. When the access door or panel is opened, the safety interlock switch is non-depressed (open) and deactivated. In the non-depressed (open) and deactivated position, the switch shuts off the electrical power to the HVAC unit or electrical appliance for safety and to avoid electrical shock. For a dryer or other electrical appliance, the safety interlock switch typically transitions to an open or deactivated position when the door is open, thereby preventing the dryer from starting when the door is open. For an HVAC unit, the access panel or door has a safety interlock switch that shuts down all power within the unit when the panel or door is open.

When the safety interlock switch is in the non-depressed (open) or deactivated position, a trained professional is unable to test the electrical components without electrical power to the HVAC unit or appliance. Common methods used by technicians for circumventing the purpose of the safety interlock switch is to tape over the switch or jam a small knife blade into the switch forcing it to remain in the depressed or activated position while the technician performs diagnostics. The circumvention of the safety interlock switch reconnects the electrical power to the HVAC unit or appliance facilitating hot testing and diagnosis. However, technicians often forget to remove the tape from the switch after the maintenance or repair is complete. The access door is closed over the tape and the switch is disabled, creating dangerous circumstances for the homeowner.

Most conventional HVAC units use a switching system to control various functions of the HVAC system, including the safety interlock switch. This switching system can be complicated when used or serviced in accordance with its standard operation and construction. The technician may also use a lock-out device, which works with a safety interlock switch to shut off the electricity and pneumatic power system during maintenance. Such a lock-out device can be cumbersome and too large to fit into a pocket. Another drawback of conventional interlock switch tools is that the mechanism usually requires the technician to use both hands to operate it.

SUMMARY

An apparatus and method for a safety interlock door switch tool are disclosed. The door switch tool of various example embodiments can depress and hold the safety interlock switch on the door casing of an HVAC unit while the HVAC unit door is removed or opened so that a technician can service, inspect, and diagnose the HVAC unit with the door off and the safety interlock switch activated.

The safety interlock door switch tool of various example embodiments can be attached to the face of the safety interlock switch by magnets that stick to the metal casing surrounding the safety interlock switch. The safety interlock door switch tool provides different physical surfaces at different levels or heights that can depress and hold different types of door switches of varying sizes, shapes, and heights. There is no part of the door switch tool that needs to be placed near the back or rear of the safety interlock switch, which can cause a safety hazard and possible electric shock by coming into contact with the wires at the rear of the safety interlock switch.

BRIEF DESCRIPTION OF THE DRAWINGS

Embodiments are illustrated by way of example and not limitation in the figures of the accompanying drawings, in which.

DETAILED DESCRIPTION

In the following detailed description, reference is made to the accompanying drawings that form a part hereof, and in which are shown, by way of illustration, specific embodiments in which the disclosed subject matter can be practiced. It is understood that other embodiments may be utilized and structural changes may be made without departing from the scope of the disclosed subject matter.

According to various example embodiments of the disclosed subject matter as described herein, there is disclosed, illustrated, and claimed an apparatus and method for a safety interlock door switch tool. The example embodiments disclosed herein provide an apparatus, system, and method implemented as a safety interlock door switch tool, which can be used in a variety of applications including servicing HVAC units, electrical appliances, and other systems having safety interlock door switches.

Figure 1:
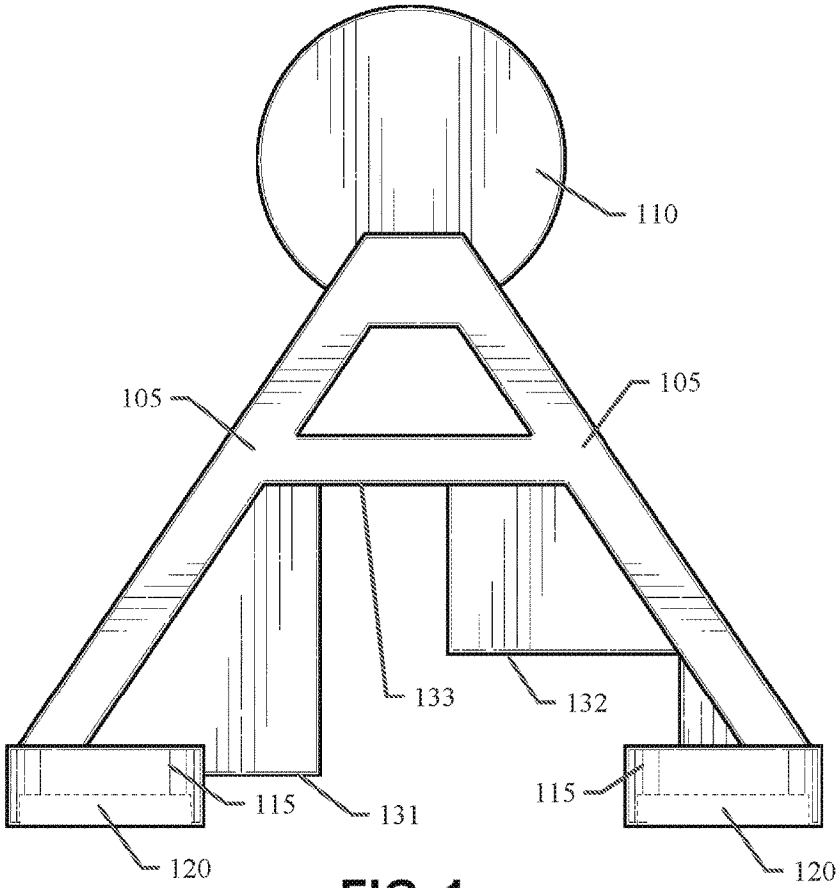
FIG. 1 illustrates a front view of the safety interlock door switch tool of an example embodiment.

Referring now to FIGS. 1 through 6, an example embodiment of the safety interlock door switch tool 100 is illustrated. FIG. 1 illustrates a front view of the safety interlock door switch tool of an example embodiment. In the example embodiment shown, the safety interlock door switch tool 100 includes support posts 105, grip element 110, and base elements 115. The grip element 110 is integrated into or coupled to the top of the support posts 105 where the support posts 105 meet at a point. The grip element 110 can be used by a technician to grip and place the tool 100 on a safety interlock switch with one hand as described in more detail below. The base elements 115 are integrated into or coupled to the lower ends of the support posts 105 to provide a means for attaching the tool 100 to a surface of a switch support structure, such as an HVAC unit or electrical appliance door or door frame. An attachment mechanism 120 (e.g., magnets) is integrated or coupled into a recessed portion of the base elements 115. In an example embodiment, the attachment mechanism 120 can be a pair of magnets for attaching the tool 100 to a metallic portion of the switch support structure. In other embodiments, the attachment mechanism 120 can be an adhesive or sticky pad, or other attachment means for temporarily and removably attaching the tool 100 to a surface of the switch support structure.

The safety interlock door switch tool 100 of an example embodiment is further configured to include first switch depression surface 131, second switch depression surface 132, and third switch depression surface 133. It will be apparent to those of ordinary skill in the art in view of the disclosure herein that any number of switch depression surfaces can be provided in various alternative embodiments. Each switch depression surface 131/132/133 presents a surface at a different height relative to the bottom edge of the base elements 115. As a result, the different heights of each of the switch depression surfaces 131/132/133 can correspond to a different type of safety interlock switch in a depressed or activated position. Thus, the safety interlock door switch tool 100 can be placed over safety interlock switches of various types and can accommodate the different sizes of the different types of safety interlock switches. This feature of the example embodiment is described in more detail below in connection with FIGS. 4 through 6.

Figure 2:
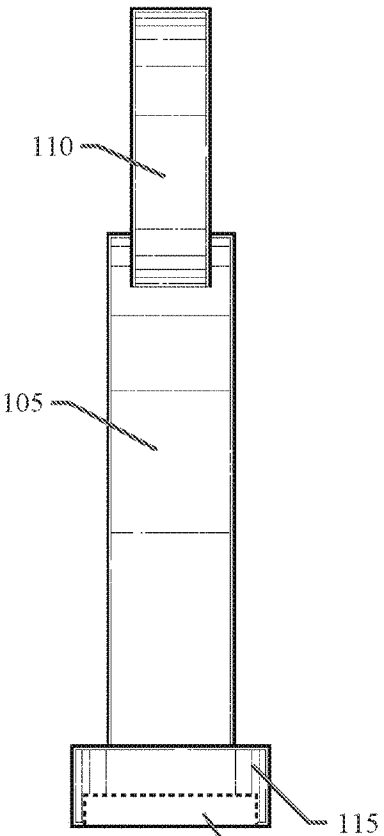
FIG. 2 illustrates a side view of the safety interlock door switch tool of an example embodiment.

FIG. 2 illustrates a side view of the safety interlock door switch tool 100 of an example embodiment. As shown, the door switch tool 100 can include a grip element 110, which can be used by a technician to grip and place the tool 100 on a safety interlock switch with one hand. The support posts 105 can be configured to be as tall or high as necessary to accommodate the largest type of safety interlock door switch.

Figure 3:
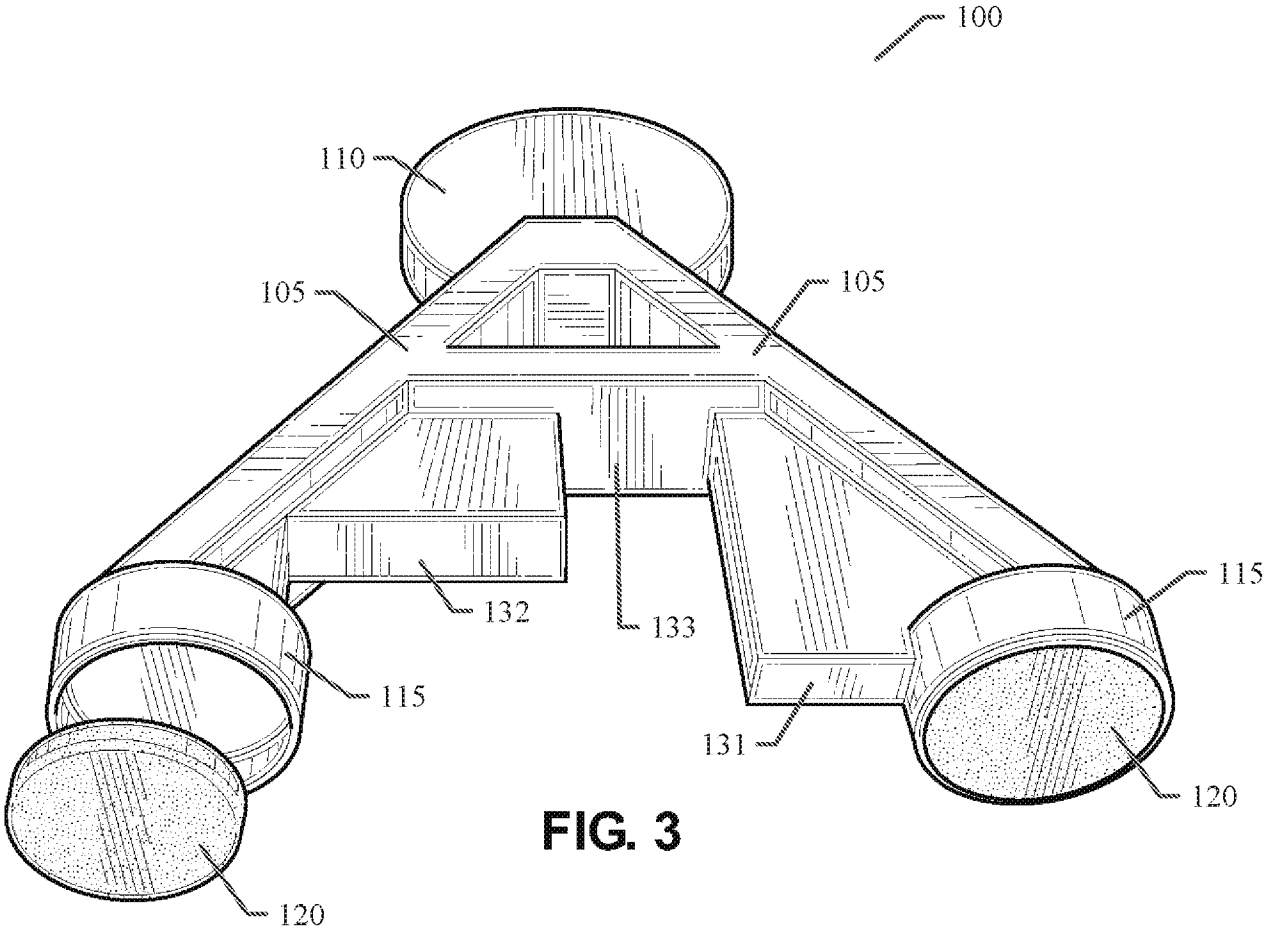
FIG. 3 illustrates a perspective bottom side view of the safety interlock door switch tool of an example embodiment.

FIG. 3 illustrates a perspective bottom side view of the safety interlock door switch tool 100 of an example embodiment. As shown, the door switch tool 100 can include base elements 115 with a recessed portion. An attachment mechanism 120 (e.g., magnets) can be integrated or coupled into the recessed portion of the base elements 115. The safety interlock door switch tool 100 of an example embodiment can also include a plurality of switch depression surfaces 131/132/133 to provide a plurality of surfaces at different heights to accommodate the different sizes of the different types of safety interlock switches. Each of the switch depression surfaces 131/132/133 can be configured with enough surface area to enable the depression or activation of a safety interlock switch of a corresponding type when the safety interlock door switch tool 100 is placed over a safety interlock switch and brought into contact with a corresponding switch depression surface 131/132/133.

Therefore, as described herein, the safety interlock door switch tool 100 of an example embodiment can comprise support posts 105 having a top end and a bottom end; base elements 115 coupled to the bottom end of the support posts 105, an attachment mechanism 120 being coupled to the base elements 115; a grip element 110 coupled to the top end of the support posts 105; and a plurality of switch depression surfaces 131/132/133 formed between the support posts 105, each of the plurality of switch depression surfaces 131/132/133 being configured to engage and activate a particular type of safety interlock door switch.

Figure 4:
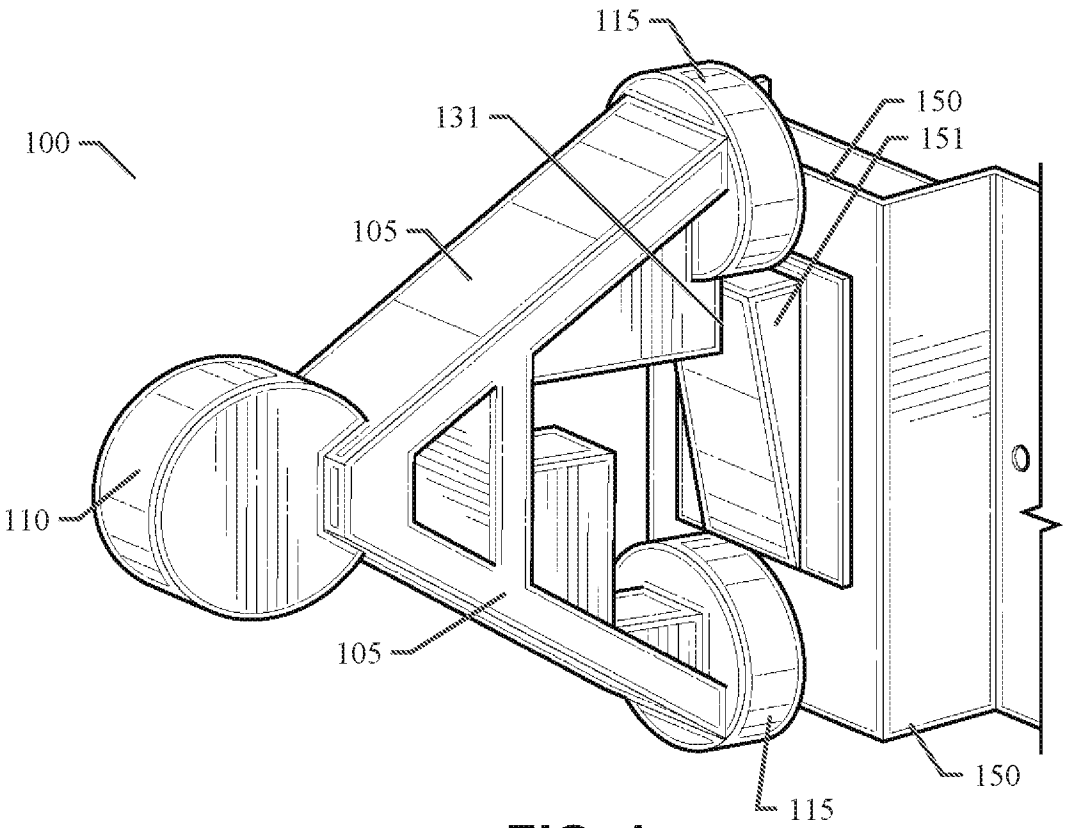
FIGS. 4 through 6 illustrate example embodiments of the safety interlock door switch tool as engaged on a safety interlock door switch of various shapes, sizes, and heights.
Figure 5:
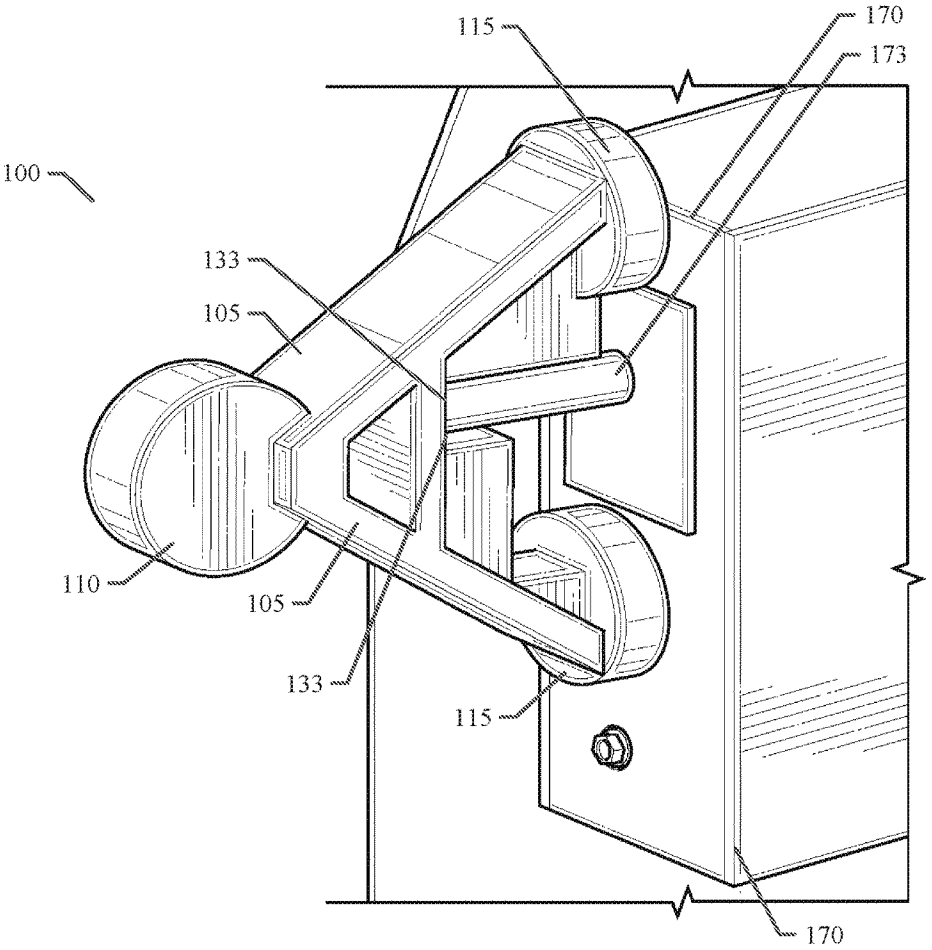
Figure 6:
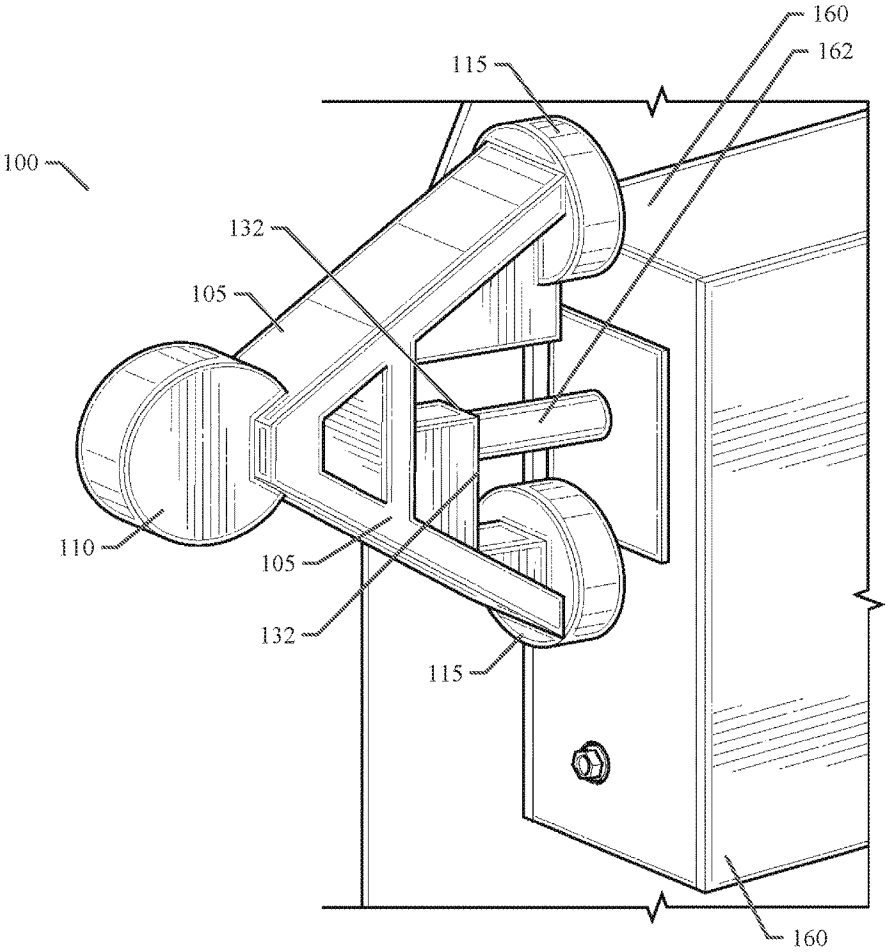

FIGS. 4 through 6 illustrate example embodiments of the safety interlock door switch tool 100 as engaged on safety interlock door switches of various shapes, sizes, and heights. As shown in FIG. 4, the safety interlock door switch tool 100 is engaged on a safety interlock door switch 151. The safety interlock door switch 151 is installed in or on a first interlock switch support structure 150. The safety interlock door switch 151 can be of a first type with particular dimensions, including a particular height when the switch is depressed. The first interlock switch support structure 150 can be a standard switch support structure as provided in an HVAC unit or electrical appliance. Such switch support structures can be provided on the doors or door casings of the standard HVAC unit or electrical appliance. In most cases, the switch support structure is fabricated from metal or type of material to which a magnet will attach. Thus, as shown in FIG. 4, the attachment mechanism 120 of the base elements 115 can be removably attached to a portion of the first interlock switch support structure 150. As a result, the safety interlock door switch tool 100 can be removably engaged with the first interlock switch support structure 150. Moreover, the safety interlock door switch tool 100 can be removably engaged with the first interlock switch support structure 150 to cause the first switch depression surface 131 to depress the safety interlock door switch 151 of a first type into an active position. This engagement of the safety interlock door switch tool 100 onto the safety interlock door switch 151 can be performed using the grip element 110 captured between two fingers of one hand. Thus, the safety interlock door switch tool 100 of an example embodiment can depress and hold the safety interlock door switch 151 of a first type on the first interlock switch support structure 150 of an HVAC unit while the HVAC unit door is removed or opened so that a technician can service, inspect, and diagnose the HVAC unit with the door off and the safety interlock switch 151 activated.

As shown in FIG. 5, the safety interlock door switch tool 100 is engaged on a safety interlock door switch 173. The safety interlock door switch 173 is installed in or on a third interlock switch support structure 170. The safety interlock door switch 173 can be of a third type with particular dimensions, including a particular height when the switch is depressed. The third interlock switch support structure 170 can be a standard switch support structure as provided in an HVAC unit or electrical appliance. Such switch support structures can be provided on the doors or door casings of the standard HVAC unit or electrical appliance. As shown in FIG. 5, the attachment mechanism 120 of the base elements 115 can be removably attached to a portion of the third interlock switch support structure 170. As a result, the safety interlock door switch tool 100 can be removably engaged with the third interlock switch support structure 170. Moreover, the safety interlock door switch tool 100 can be removably engaged with the third interlock switch support structure 170 to cause the third switch depression surface 133 to depress the safety interlock door switch 173 of a third type into an active position. This engagement of the safety interlock door switch tool 100 onto the safety interlock door switch 173 can be performed using the grip element 110 captured between two fingers of one hand. Thus, the safety interlock door switch tool 100 of an example embodiment can depress and hold the safety interlock door switch 173 of a third type on the third interlock switch support structure 170 of an HVAC unit while the HVAC unit door is removed or opened so that a technician can service, inspect, and diagnose the HVAC unit with the door off and the safety interlock switch 173 activated.

As shown in FIG. 6, the safety interlock door switch tool 100 is engaged on a safety interlock door switch 162. The safety interlock door switch 162 is installed in or on a second interlock switch support structure 160. The safety interlock door switch 162 can be of a second type with particular dimensions, including a particular height when the switch is depressed. The second interlock switch support structure 160 can be a standard switch support structure as provided in an HVAC unit or electrical appliance. As shown in FIG. 6, the attachment mechanism 120 of the base elements 115 can be removably attached to a portion of the second interlock switch support structure 160. As a result, the safety interlock door switch tool 100 can be removably engaged with the second interlock switch support structure 160. Moreover, the safety interlock door switch tool 100 can be removably engaged with the second interlock switch support structure 160 to cause the second switch depression surface 132 to depress the safety interlock door switch 162 of a second type into an active position. This engagement of the safety interlock door switch tool 100 onto the safety interlock door switch 162 can be performed using the grip element 110 captured between two fingers of one hand. Thus, the safety interlock door switch tool 100 of an example embodiment can depress and hold the safety interlock door switch 162 of a second type on the second interlock switch support structure 160 of an HVAC unit while the HVAC unit door is removed or opened so that a technician can service, inspect, and diagnose the HVAC unit with the door off and the safety interlock switch 162 activated.

In an example embodiment, the distance of 30 mm between the two support posts 105 can be a very precise measurement to accommodate particular types of switches. In many cases, if this measurement is 10 mm wider, the two support posts 105 would not contact the metal on both sides of many switches. If this measurement is 10 mm shorter, the two support posts 105 would hit the plastic on one side of most switches. On the safety interlock door switch tool 100 of an example embodiment, the distance from the base to the contact point of each of the three levels is set precisely to prevent the door switch tool 100 from being too close or too far away from depressing most available types of switches.

Figure 7:
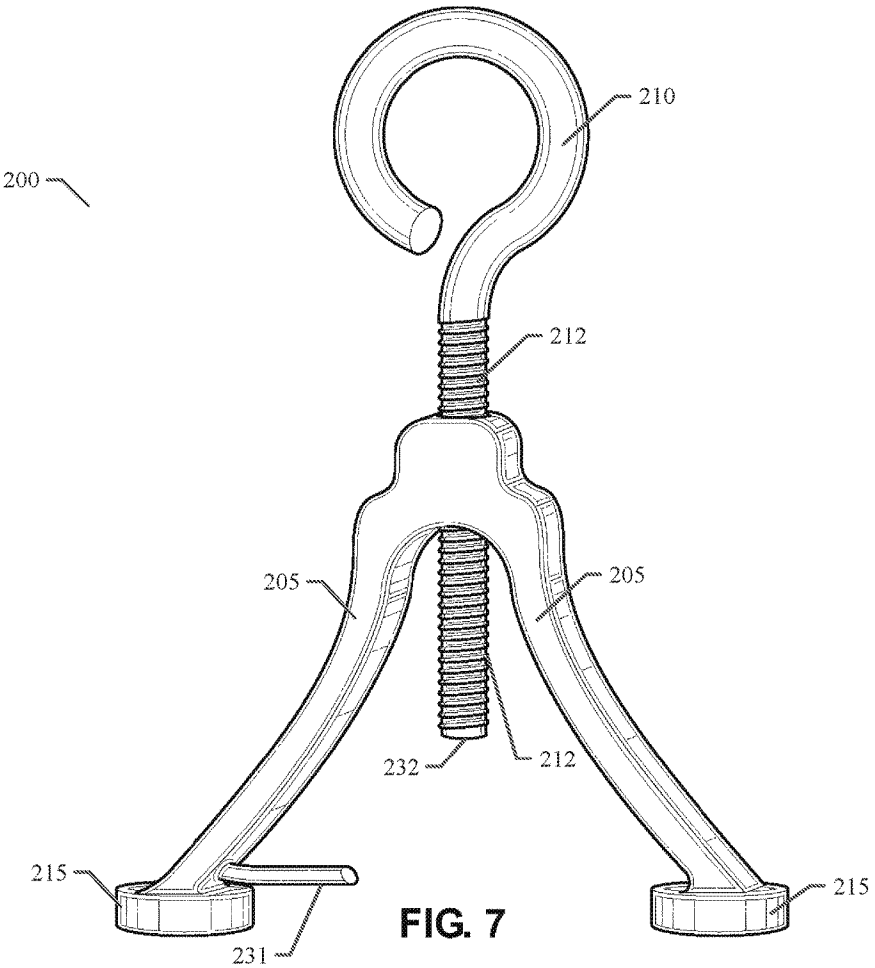
FIG. 7 illustrates an alternative example embodiment of the safety interlock door switch tool.

FIG. 7 illustrates an alternative example embodiment of the safety interlock door switch tool 200. The alternative safety interlock door switch tool 200 includes support posts 205, grip element 210, and base elements 215. The grip element 210 can be implemented as an eye bolt inserted and screwed into a threaded hole at the top of the support posts 205 where the support posts 205 meet at a point. The grip element 210 can be used by a technician to grip and place the tool 200 on a safety interlock switch with one hand as described in more detail below. The base elements 215 are integrated into or coupled to the lower ends of the support posts 205 to provide a means for attaching the tool 200 to a surface of a switch support structure, such as an HVAC unit or electrical appliance door or door frame. An attachment mechanism (e.g., magnets not shown) is integrated or coupled into a recessed portion of the base elements 215. In an example embodiment, the attachment mechanism can be a pair of magnets for attaching the tool 200 to a metallic portion of the switch support structure. In other embodiments, the attachment mechanism can be an adhesive or sticky pad, or other attachment means for temporarily and removably attaching the tool 200 to a surface of the switch support structure.

The safety interlock door switch tool 200 of an example embodiment is further configured to include first switch depression surface 231 and a variable-height second switch depression surface 232. It will be apparent to those of ordinary skill in the art in view of the disclosure herein that any number of switch depression surfaces can be provided in various alternative embodiments. Each switch depression surface 231/232 presents a surface at a different height relative to the bottom edge of the base elements 215. The height of the second switch depression surface 232 can be varied by turning the grip element 210 clockwise or counterclockwise to cause the threaded shaft 212 to raise or lower the height of the second switch depression surface 232. As a result, the different heights of each of the switch depression surfaces 231/232 can correspond to a different type of safety interlock switch in a depressed or activated position. Thus, the safety interlock door switch tool 200 can be placed over safety interlock switches of various types and accommodate the different sizes and heights of the different types of safety interlock switches. The safety interlock door switch tool 200 can even be placed over inset safety interlock switches as the safety interlock door switch tool 200 can be screwed down enough to engage with inset switches.

Figure 8:
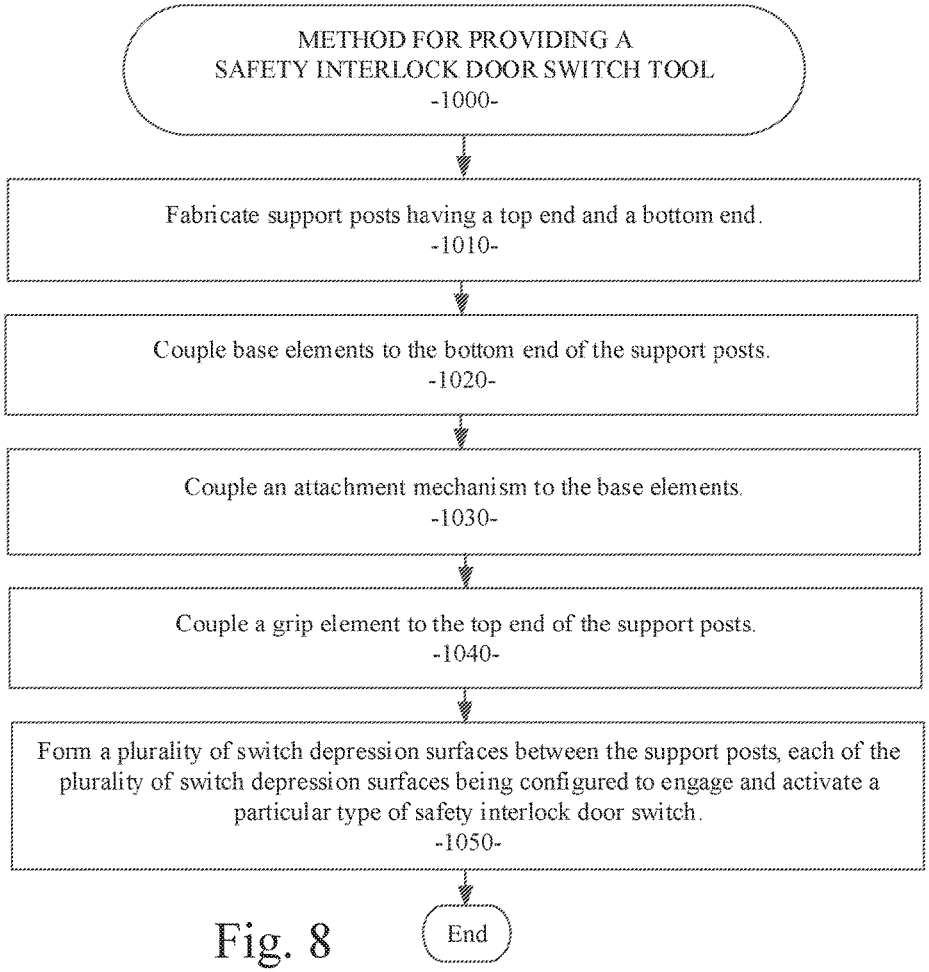
FIG. 8 illustrates a flow diagram representing a sequence of operations performed in a method according to an example embodiment.

FIG. 8 illustrates a flow diagram representing a sequence of operations performed in a method according to an example embodiment. In accordance with the example method 1000, the method comprises: fabricating support posts having a top end and a bottom end (operation 1010); coupling base elements to the bottom end of the support posts (operation 1020); coupling an attachment mechanism to the base elements (operation 1030); coupling a grip element to the top end of the support posts (operation 1040); and forming a plurality of switch depression surfaces between the support posts, each of the plurality of switch depression surfaces being configured to engage and activate a particular type of safety interlock door switch (operation 1050).

The illustrations of embodiments described herein are intended to provide a general understanding of the structure of various embodiments, and they are not intended to serve as a complete description of all the elements and features of components and systems that might make use of the structures described herein. Many other embodiments will be apparent to those of ordinary skill in the art upon reviewing the description provided herein. Other embodiments may be utilized and derived, such that structural and logical substitutions and changes may be made without departing from the scope of this disclosure. The figures herein are merely representational and may not be drawn to scale. Certain proportions thereof may be exaggerated, while others may be minimized. Accordingly, the specification and drawings are to be regarded in an illustrative rather than a restrictive sense.

The description herein may include terms, such as "up", "down", "upper", "lower", "first", "second", etc. that are used for descriptive purposes only and are not to be construed as limiting. The elements, materials, geometries, dimensions, and sequence of operations may all be varied to suit particular applications. Parts of some embodiments may be included in, or substituted for, those of other embodiments. While the foregoing examples of dimensions and ranges are considered typical, the various embodiments are not limited to such dimensions or ranges.

The Abstract is provided to allow the reader to quickly ascertain the nature and gist of the technical disclosure. The Abstract is submitted with the understanding that it will not be used to interpret or limit the scope or meaning of the claims.

In the foregoing Detailed Description, various features are grouped together in a single embodiment for the purpose of streamlining the disclosure. This method of disclosure is not to be interpreted as reflecting an intention that the claimed embodiments have more features than are expressly recited in each claim. Thus, the following claims are hereby incorporated into the Detailed Description, with each claim standing on its own as a separate embodiment.

As described herein, an apparatus and method for a safety interlock door switch tool are disclosed. Although the disclosed subject matter has been described with reference to several example embodiments, it may be understood that the words that have been used are words of description and illustration, rather than words of limitation. Changes may be made within the purview of the appended claims, as presently stated and as amended, without departing from the scope and spirit of the disclosed subject matter in all its aspects. Although the disclosed subject matter has been described with reference to particular means, materials, and embodiments, the disclosed subject matter is not intended to be limited to the particulars disclosed; rather, the subject matter extends to all functionally equivalent structures, methods, and uses such as are within the scope of the appended claims.

What is claimed is:

1. A safety interlock door switch override tool comprising:

support posts having a top end and a bottom end;

base elements coupled to the bottom end of the support posts, an attachment mechanism being coupled to the base elements, wherein the attachment mechanism is a magnet;

a grip element coupled to the top end of the support posts; and a plurality of switch depression surfaces formed between the support posts, each of the plurality of switch depression surfaces being configured to engage and activate a particular type of safety interlock door switch.

2. The safety interlock door switch override tool of claim 1 wherein the attachment mechanism is coupled into a recessed portion of the base elements.

3. The safety interlock door switch override tool of claim 1 wherein the attachment mechanism is configured to removably attach to a standard switch support structure.

4. The safety interlock door switch override tool of claim 1 wherein each of the plurality of switch depression surfaces presenting a surface at a different height relative to a bottom edge of the base elements.

5. The safety interlock door switch override tool of claim 1 having three switch depression surfaces presenting three different surfaces at three different heights relative to a bottom edge of the base elements.

6. The safety interlock door switch override tool of claim 1 wherein at least one of the plurality of switch depression surfaces is a variable-height switch depression surface.

7. The safety interlock door switch override tool of claim 1 wherein grip element is an eye bolt.

8. A method for producing a tool for overriding a safety interlock of a door switch, the method comprising:

fabricating support posts having a top end and a bottom end;

coupling base elements to the bottom end of the support posts;

coupling an attachment mechanism to the base elements, wherein the attachment mechanism is a magnet;

coupling a grip element to the top end of the support posts; and forming a plurality of switch depression surfaces between the support posts, each of the plurality of switch depression surfaces being configured to engage and activate a particular type of safety interlock door switch.

9. The method of claim 8 wherein the attachment mechanism is coupled into a recessed portion of the base elements.

10. The method of claim 8 wherein the attachment mechanism is configured to removably attach to a standard switch support structure.

11. The method of claim 8 wherein each of the plurality of switch depression surfaces presenting a surface at a different height relative to a bottom edge of the base elements.

12. The method of claim 8 including forming three switch depression surfaces presenting three different surfaces at three different heights relative to a bottom edge of the base elements.

13. The method of claim 8 wherein at least one of the plurality of switch depression surfaces is a variable-height switch depression surface.

14. The method of claim 8 wherein grip element is an eye bolt.

* * * * *